United States Patent [19]

Schaefer

[11] 4,297,041

[45] Oct. 27, 1981

[54] VARIABLE CAM PROFILE SELECTION SYSTEM FOR SINGLE ELEMENT TYPEWRITER

[75] Inventor: John O. Schaefer, Lexington, Ky.

[73] Assignee: International Business Machines Corporation, Armonk, N.Y.

[21] Appl. No.: 25,824

[22] Filed: Apr. 2, 1979

[51] Int. Cl.[3] ..... B41J 1/32

[52] U.S. Cl. ..... 400/161.4; 400/161.5

[58] Field of Search ..... 400/161.1, 161.2, 161.3, 400/161.4, 161.5, 162, 162.1, 164.2, 164.3, 164.5, 164.6; 74/22 R, 22 A, 25, 53, 54, 55, 60

[56] References Cited

U.S. PATENT DOCUMENTS

| | | | |
|---|---|---|---|
| 2,919,002 | 12/1959 | Palmer | 400/162.1 X |
| 3,302,765 | 2/1967 | Hickerson et al. | 400/161.4 X |
| 3,666,070 | 5/1972 | Schaefer | 400/161.5 |
| 3,885,662 | 5/1975 | Schaefer | 400/161.5 |
| 3,892,304 | 7/1975 | Shakib | 400/161.4 X |
| 3,948,381 | 4/1976 | McDaniel et al. | 400/161.5 |
| 3,981,386 | 9/1976 | Abell et al. | 400/161.5 |
| 3,983,984 | 10/1976 | de Kler | 400/161.4 |
| 4,059,184 | 11/1977 | Redding et al. | 400/161.5 |
| 4,094,397 | 6/1978 | Hughes | 400/161.5 X |

OTHER PUBLICATIONS

IBM Technical Disclosure Bulletin, "Nonhoming Translating Rack Shift Mechanism", Henderson et al., vol. 18, No. 11, Apr. 1976, pp. 3748–3749.

IBM Technical Disclosure Bulletin, "Very Fine Adjustment of Selection Rack to Pinion", Boyatt et al., vol. 18, No. 11, Apr. 1976, p. 3750.

*Primary Examiner*—Ernest T. Wright, Jr.

*Attorney, Agent, or Firm*—Laurence R. Letson

[57] ABSTRACT

A variable cam profile selection system is disclosed having cams controlling both the tilt and the rotate motion of the single element typewriter. The tilt cam and rotate cam are mounted so that they may be moved with respect to their support to vary the cam rise. The rise of the cam is controlled by interposers under the influence of the keyboard to select or define the amount of movement of the cam member, thereby defining the cam rise. The single cam member for each movement may be positioned in any one of a plurality of positions and, by so doing, correspondingly effect the movement of the cam follower as the cam is rotated about an axis.

22 Claims, 7 Drawing Figures

FIG. 3
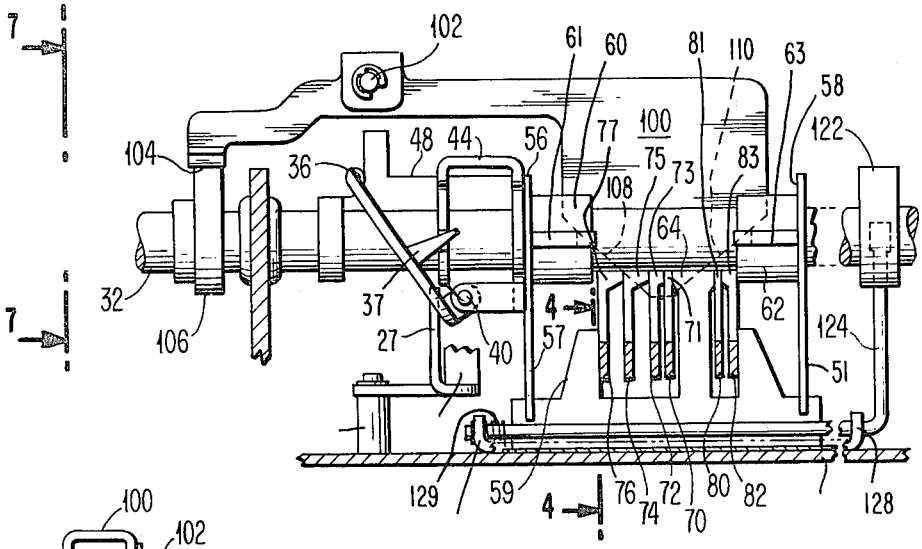
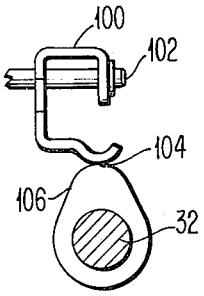
FIG. 7
FIG. 4
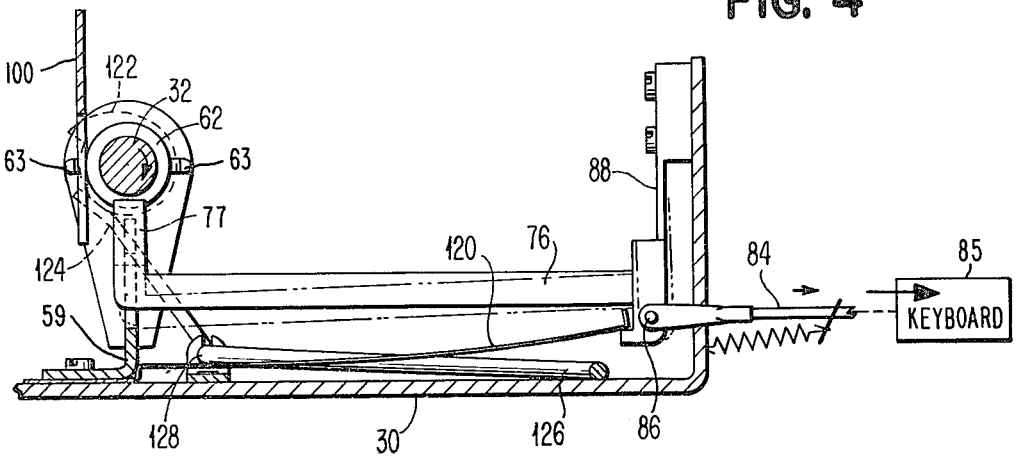

VARIABLE CAM PROFILE SELECTION SYSTEM FOR SINGLE ELEMENT TYPEWRITER

BACKGROUND OF THE INVENTION

Single element typewriters have historically utilized a rotating shaft to effect cam rotation. The shaft either carried with it a single cam with a plurality of cam grooves, each individually selectable by its own cam follower, such as that found in Shakib, U.S. Pat. No. 3,892,304, or a single cam groove was formed into a rotating shaft with a form of a relievable follower assembly attached driveably to that cam groove as in DeKler, U.S. Pat. No. 3,983,984 and Hughes, U.S. Pat. No. 4,094,397. The rotation of the shaft to provide the movement of a cam in its simplest form will provide only a single defined mechanical output absent a plurality of cam surfaces or a motion modifying device. The DeKler and Hughes patents provide an alternative to multiple cam surfaces but utilized a fixed cam drive. The fixed cam drive must be defined in such a way that the cam rise is fast enough to accommodate the greatest possible amount of selection movement required of the type element and, therefore, must generate higher than required accelerations and forces during many of the printing and selection cycles of the typewriter. It is desirable to overcome the high loading conditions and reduce accelerations and forces generated during the selection cycle. The avoidance of high loading and accelerations on the drive system of the typewriter may be accomplished by multiple cam surfaces as the prior art has implemented, but the requirement of extensive adjustments and the multiplication of parts makes the manufacture of the apparatus more complicated and expensive.

Another example of a multiple cam surface selection apparatus is Schaefer, U.S. Pat. No. 3,666,070 where face cam surfaces are formed conically into a cam cylinder. Cam profiles are expensive to design and to manufacture in materials which will withstand high stresses and, therefore, increase the expense of such a typewriter.

The DeKler patent referred to above discloses a spring biased detent ball acting as a cam follower in a continuing cam groove to translate a follower block into forceable engagement with a controllable and selectable stop member. The detent ball relieves forces of the cam groove against the follower block when the follower block has forceably engaged the increment defining interposers. An alternative and improved approach which reduced forces and stresses involved in driving the selection system is disclosed in the Hughes patent where a follower block riding in a shuttle engages a stop member and then is spring relieved to provide a capability of driving the shuttle through the remainder of its movement while stopping the typehead movement defining linkage attached to the individual follower blocks.

The DeKler and Hughes devices, while both driving the rotate linkage only so far as needed for selection, must accommodate high acceleration and deceleration forces during the early portion of a print cycle regardless of the amount of rotation of the typehead desired and, therefore, is subjected to unnecessarily high forces during many of the selection cycles. The Schaefer patent, although not requiring excessive acceleration and loading of the selection system during the cycles selecting relatively close or low rotate value characters, requires a more complex cam with concomitant design and manufacturing problems.

The variable cam profile selection system disclosed herein utilizes two ring members pivoted on collars mounted on a print shaft capable of rotation in a cyclic manner. The annular ring cam surfaces are thus able to pivot with respect to these collars, thereby presenting to the cam follower engaged therewith, a cam rise of controlled but variable height. By controlling the height with a mechanical device such that the height of the cam rise corresponds to the input increment required to control the rotation of the type element for a desired quantity of element rotation and likewise element tilt, the mechanical displacement of the followers may be translated from the variable cam profiles to varying but controlled rotation and tilt increments of the typehead. The amount of cam rise is controlled by the removal of interposers from a zone of engagement with a stop member and a moveable cam control slide surface. If all interposers are left in the zone of engagement, the cam will exhibit its highest rise while with each additional removal of interposers, the cam rise will diminish. The interposers are extracted prior to the initiation of a selection cycle and remain extracted from the zone of engagement until the completion of the selection cycle and the restoration of the cam member and the cam slide.

In summary, the invention is a unitary cam member capable of movement under control of a selectable apparatus to be positioned, thereby providing a plurality of cam rises from a single cam member.

OBJECTS OF THE INVENTION

It is an object of this invention to control the rotate and the tilt of a single element printing member with a variable rise cam for each function.

It is another object of this invention to vary output of a single cam surface by controlling the cam rise.

It is an additional object of this invention to reduce forces on the selection mechanism of a typewriter by reducing the acceleration experienced in the mechanism by reducing cam rises commensurate with the required displacement for selection.

The foregoing and other objects, features and advantages of the invention will be apparent from the following more particular description of a preferred embodiment of the invention, as illustrated in the accompanying drawing.

DESCRIPTION OF THE DRAWING

FIG. 3 is a front section view of the interposers and a front view of the variable cam selection control system shown in FIG. 1 along line 3—3.

FIG. 4 is a section view taken along line 4—4 in FIG. 3.

FIG. 7 is a sectional view taken along line 7—7 in FIG. 3.

DETAILED DESCRIPTION

Figure 1:
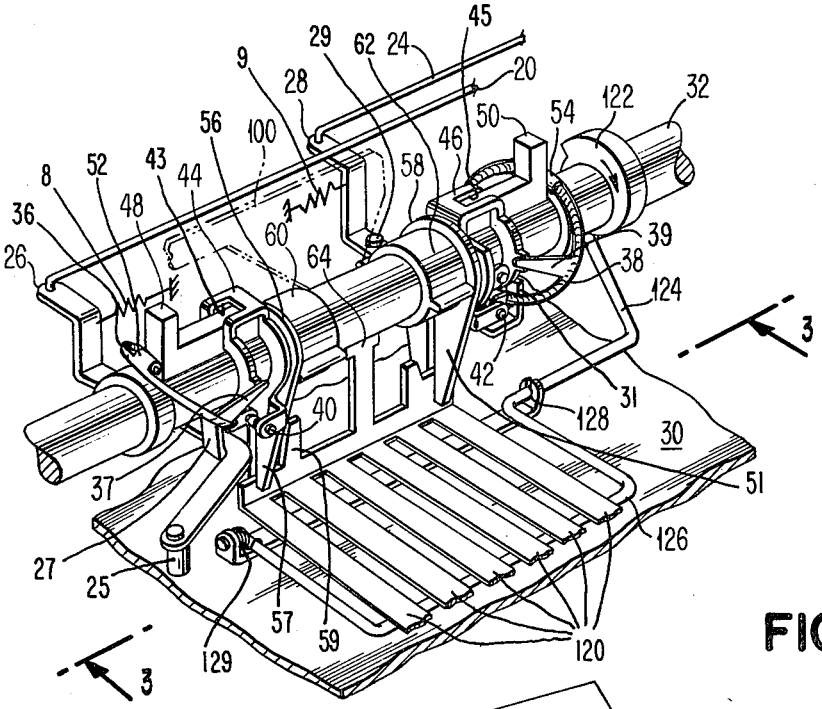
FIG. 1 is a prospective view of the variable cam rise selection control.
Figure 2:
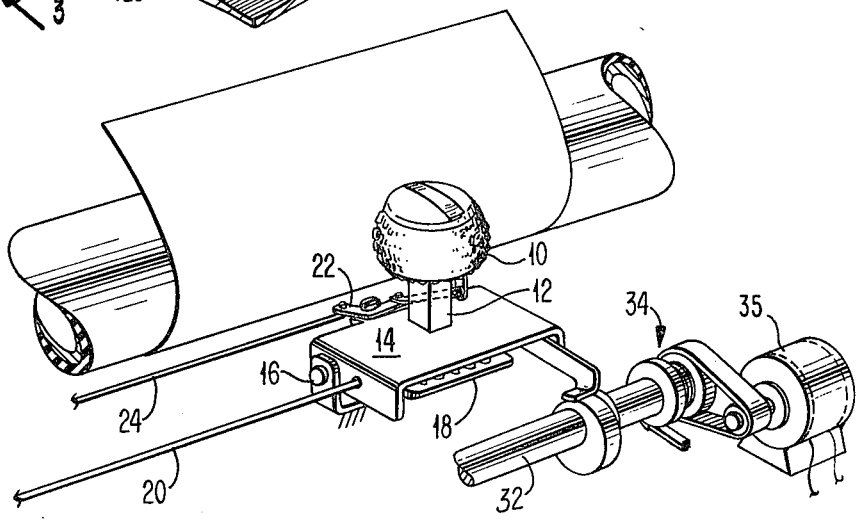
FIG. 2 illustrates the connections from FIG. 1 to the type element and the mechanism for accomplishing printing thereby.

Referring to FIGS. 1 and 2, a typehead 10 is supported for rotation and tilt by yoke 12 on rocker 14. Rocker 14 is attached by a mounting bracket 16 in a pivotal manner to the frame 30 of the typewriter. The motion converting portion of the rotation and tilt control mechanism is rack 18 and link 20 deriving rotation and bellcrank 22 and link 24 deriving the tilt motion of the typehead 10. Examples of the detail of the rotate and tilt apparatus which may be incorporated herein may be found in Shakib, U.S. Pat. No. 3,892,304, with particular reference to FIG. 9 therein. A detailed discussion of the rotate and tilt mechanisms in the rocker 14, yoke 12, supporting the typehead 10 is not necessary inasmuch as it does not constitute any part of the novel portion of the invention.

Links 20 and 24 derive their movement from cam followers 26 and 28. Both cam followers 26 and 28 are pivotally mounted for oscillatory movement with respect to the frame 30 of the typewriter. Operational shaft 32 is rotatably supported with respect to the frame 30 of the typewriter and may be driven in any conventional manner through a cycle clutch 34 by a conventional electric motor 35. The operational shaft 32 will provide the drive for a number of functions to be discussed below, in a cyclical keyboard controlled manner.

To derive motion of the cam followers 26, 28, cam members 36, 38 are provided in a generally circular form. The cam members 36, 38 are pivotally mounted at pivot point 40, 42, respectively, upon mounting collars 44, 46, respectively. Mounting collars 44, 46 are rigidly attached to operational shaft 32 for rotation therewith. The mounting pivot 40, 42 will then carry cam members 36, 38 with the collars 44, 46 as they rotate with operational shaft 32. Stabilizer arms 37,39 extend from cam members 36,38 to improve lateral stability of the cam members 36,38 during rotation.

Slider 48 and slider 50 engage surfaces 52 and 54 on cam members 36 and 38, respectively. Sliders 48 and 50 extend through openings 43, 45 in collars 44 and 46 and engage bearing flanges 56 and 58, respectively. Flanges 56 and 58 may be formed as a part of slide bearings 60, 62, respectively.

As the rotate interposers 70, 72, 74, 76 and tilt interposers 80, 82 are compressed into a dimensional defining relationship against fixed stop member 64, compression is effected by the movement of slides 60 and 62 toward each other and toward stop member 64. The compression forces result from the resistance of the cam followers 27, 31 engaging the cam members 36, 38, cam followers 27, 31 being a part of cam followers 26, 28 respectively. Cam followers 26, 28 are respectively supported by supports 25, 29. Restore springs 8, 9 or other conventional biasing force means insure cam followers 27, 31 engagement with cam surfaces 36, 38. A better understanding of this relationship can be had from referring to FIG. 3. The interposers 70, 72, 74, 76, 80, 82 and particularly their distance defining heads 71, 73, 75, 77, 81, 83 are illustrated in FIG. 3. Interposers 70, 72, 74 and 76 are utilized to control the rotate function of the typehead 10. The heads 71, 73, 75, 77 of each of the interposers 70, 72, 74, 76 are dimensioned such that they represent 1, 2, 4 and 4 units of rotation of the typehead 10, respectively.

The tilt interposers 80 and 82 control the tilting of the typehead 10 and are dimensioned such that when utilized represent, respectively, 1 and 2 units of tilt movement of the typehead 10.

Detailed explanation of the effects and interactions of parts on others will be made primarily with reference to the rotate function, it being understood that the tilt function is substantially identical except for part reversal.

As an example of the effect, the cam follower 26 is in engagement with cam member 36. As the operational shaft 32 rotates and carries with it collar 44 and slide 48, the force of the cam follower 26 will tend to cause cam member 36 to rotate about its pivot pin 40 to a position more approximating a plane perpendicular to the center line of shaft 32. Movement of cam member 36 will push slider 48 longitudionally along shaft 32 and through collar 44 exerting a force on flange 56 and thus translating slide bearing 60 rightward. As it translates slide bearing 60 rightward, any of the interposers 70 through 76 remaining in their raised position will be compressed together and against stop 64. As this occurs, slide bearing 60 will cease to translate along with flange 56. Flange 56 will not rotate with shaft 32 due to the depending legs 57 which engage guide member 59. As slide bearing 60 and flange 56 cease the actual translation along shaft 32, slider 48 will be incapable of further translation along shaft 32 and will thus block any further movement toward a plane perpendicular to the axis of shaft 32 by cam member 36. Thus, the cam rise will be defined for that particular shaft revolution.

As collar 44, slider 48 and cam member 36 rotate with shaft 32, the follower 26 will engage an increasingly higher rise portion of cam member 36 until it reaches its apogee, at which time cam follower 26 will ride down the restore slope of the cam member 36. As the cam follower 26 restores and relieves pressure on cam member 36, it will cease exerting pressure through slider 48 against flange 56 and slide bearing 60. To cause a different amount of translation of slide bearing 60, flange 56 and slider 48, thereby varying the amplitude of the cam rise of cam member 36, different interposers 70, 72, 74, 76 may be withdrawn from the zone of engagement by slide bearing 60. As an example, if a character is three columns away from the normal position of typehead 10 illustrated in FIG. 2, three units of rotation of the typehead 10 will be required to place the character in the proper rotational position for printing. In order to accomplish three rows of rotation, interposers 70 and 72, respectively, representing one and two units of rotation will be withdrawn. This is accomplished through links 84 connected to the keyboard 85.

These links 84 will act upon a pull pin 86 mounted in a lower portion of the interposer 70, 72, 74, 76, 80, 82. For sake of illustration, FIG. 4 will illustrate interposer 76, but it is understood that all other interposers 70, 72, 74, 80, 82 are attached in substantially identical manner by their respective links 84 to the keyboard 85. The link's movement will cause web 88 of the interposer 76 to deflect, thereby allowing the withdrawal of the operative end 90 of the interposer 76 from the zone of engagement with slide bearing 60. Thus, any interposer 70, 72, 74, 76, 80, 82 withdrawn from the zone of engagement with slide bearing 60 will not be effective to stop slide bearing 60 as its translates rightward in FIG. 3 along the axis of operational shaft 32. Thus, by way of the example above, three units of rotation may be accomplished by the withdrawal of interposers 70 and 72 from the zone of engagement with slide bearing 60. When withdrawn, the interposers 70 and 72 will allow the head 75 of interposer 74 to engage fixed stop member 64.

The material from which the interposers 70, 72, 74, 76, 80, 82 are made is of sufficient flexibility and resilience that they may be deflected through reasonable degrees of deformation to accomplish the engagement with fixed stop member 64.

The coding of characters can be accomplished in such a way that any four unit requirement or larger will extract interposer 76 prior to the extraction of interposer 74, thereby minimizing the maximum deflection of interposer 76. Thus, it can be seen that an interposer representing the appropriate amount of movement of slide bearing 60, when withdrawn, will be translated into a corresponding rotation of the typehead 10 through the controlled movement of rack 18. It will be apparent to one skilled in the art that the dimensioning of the interposers 70 through 76, 80 and 82, together with the appropriate fulcrum points of the cam followers 26 and 28 will require dimensioning to fit the particular geometry of the typewriter being designed. One can clearly see from FIG. 3 that the extraction of a greater amount of interposer value will result in a more shallow or flatter cam rise of cam member 36. Conversely, if a very small number of rotate units are extracted, a significantly higher cam rise will result due to slide bearing 60 engaging a series of interposers 70, 72, 74, 76, 80, 82 and being prevented from translating further.

To insure restoration of slide bearings 60, 62 upon completion of the selection of the appropriate character, a restore member 100 is provided and pivotally mounted to a frame pivot point 102. Restore member 100 is formed to provide a cam following surface 104 for engagement with a restore cam 106. Restore cam 106 is timed to have its highest rise at a period when no selection is being undertaken and the typehead 10 and all the selection apparatus is being restored to its home or rest position, such as illustrated in FIGS. 3 and 7.

Restore member 100 is formed with caming surfaces 108 and 110 which engage ribs or protrusions 61, 63 extending outward from slide bearings 60 or 62 which act as cam followers. As cam 106 causes restore member 100 to be forced downward on the right end, surfaces 108 and 110 will spread slide bearings 60 and 62 to cause their withdrawal from the zone of engagement with interposers 70 through 76 and 80, 82. This spreading will permit the interposers 70, 72, 74, 76, 80, 82 to restore. This spreading will also return flange 56, slider 48 and cam member 36 leftward and their corresponding parts slider 50, flange 58, flange legs 51 and cam member 38 rightward in anticipation of the next machine cycle.

Figure 5:
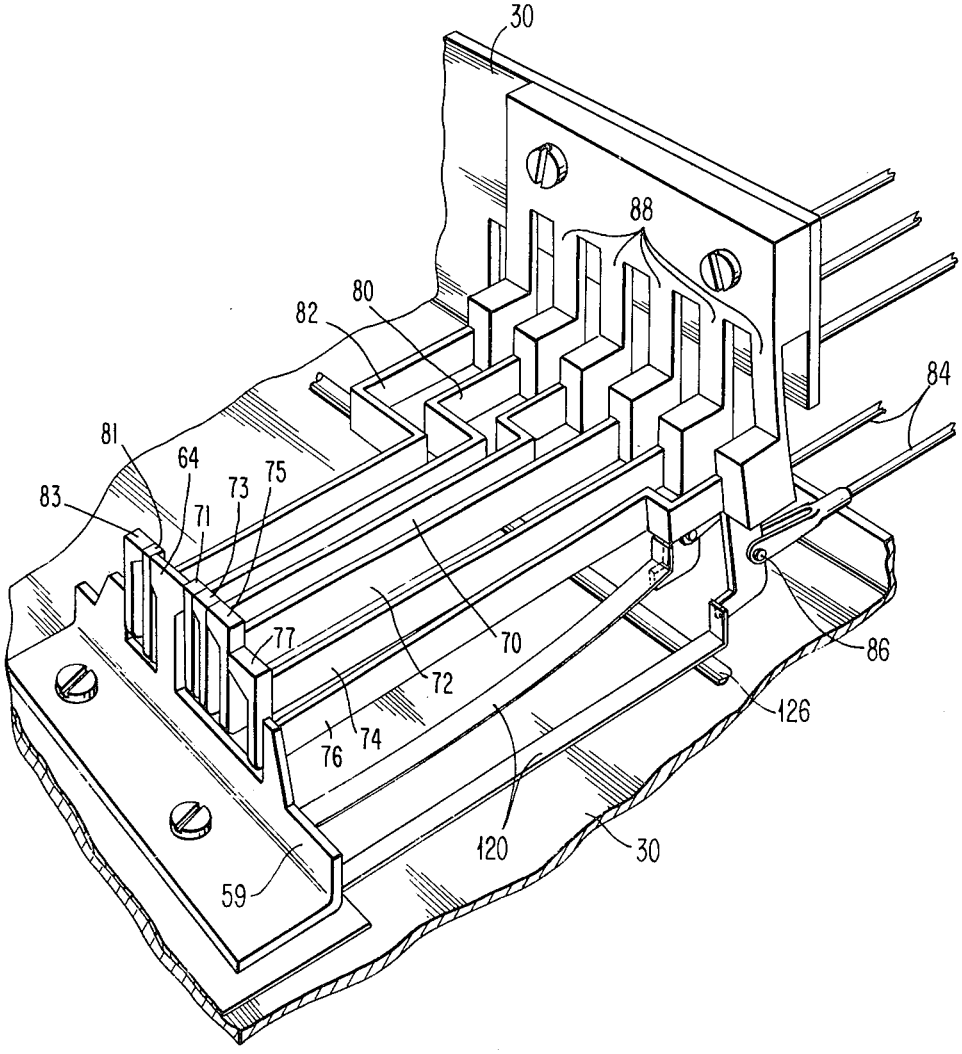
FIG. 5 is a left rear perspective view of the latch springs and selection interposers used to control the rotation of the typehead and the tilt of the typehead through the variable cam selection control mechanism.

Referring to FIG. 4 and FIG. 5, when a link 84 leading to the keyboard 85 is pulled by the keyboard 85, the web 88 will deform allowing the connection point 86 to be pulled rightward in FIG. 4 and right and upward in FIG. 5. When this occurs, spring 120 may then flex downward to act as a latch stop against interposer 76, thus preventing the interposer 76 from unintentionally restoring until after selection has occurred. With interposer 76 or any of its companion interposers held in its withdrawn position by spring 120, the operation of the variable cam selection mechanism may occur providing the proper selection. As operational shaft 32 rotates, restore cam 122 rotates therewith. As the rise of restore cam 122 engages latch spring reset follower 124, it will depress the follower arm with respect to the typewriter frame 30 and thereby rotate the offset arm 126 about pivot point 128. In so doing, the offset arm 126 will raise the leaves of spring 120 and disengage them from the bottom portion of interposer 76 or its companion interposers 70, 72, 74, 80, 82, thereby allowing the normal resilience in web 88 of interposer 76 to effect restoration of the interposer 76 to its non-selected position.

An alternative means for insuring the prevention of unintentional restoring of the interposers 70, 72, 74, 76, 80, 82 prior to initiation of the selection cycle would be to connect a small tension spring between the slide bearings 60,62 to pull them together when interposers 70, 72, 74, 76, 80, 82 are withdrawn, thus effectively latching the interposers 70, 72, 74, 76, 80, 82 in the withdrawn position. This would allow deletion of the leaf spring 120, restore cam 122, follower 124 and pivot 128. Spring 129 acts to restore offset arm 126 to its lowered position.

The explanation of operation has been made with respect to the rotate function however, except for reversal of the parts in FIG. 1, the mode of operation and function of the respective tilt control cam member 38 and slider 50, in response to the presence or absence of the tilt interposers 80, 82 is identical and operates simultaneously with the rotate selection control upon each revolution of the operational shaft 32.

OPERATION

With the operation of the keyboard 85, the selection of a character is accomplished in such a way that selected keyboard links 84 are pulled. The selected combination of the keyboard links 84 determines the cumulative effect of withdrawing none, one or more interposers 70, 72, 74, 76, 80, 82, thus defining the amount of movement of the slide bearing 60, 62. By defining the amount of movement of the slide bearings 60, 62, the amount of movement of slider 48 or 50 is likewise determined. With the displacement of sliders 48, 50 determined the movement of cam members 36, 38 is likewise controlled and the amplitude of the cam rise is determined by mechanical interference through the chain formed by the remaining or nonremoved interposers 70, 72, 74, 76, 80, 82 and the chain of parts including slide bearing 60, slider 48 and cam member 36 with respect to the rotation of the typehead 10 and slide bearing 62, slider 50 and cam member 38 with respect to the tilting of the typehead 10.

The number and selection of interposers 70 through 76 and 80, 82, removed from the zone of engagement with slide bearing 60 and 62, may be defined by the defining of interposer connection with bails in the keyboard, a conventional approach similar to that disclosed in U.S. Pat. No. 2,919,002 to Palmer.

Figure 6:
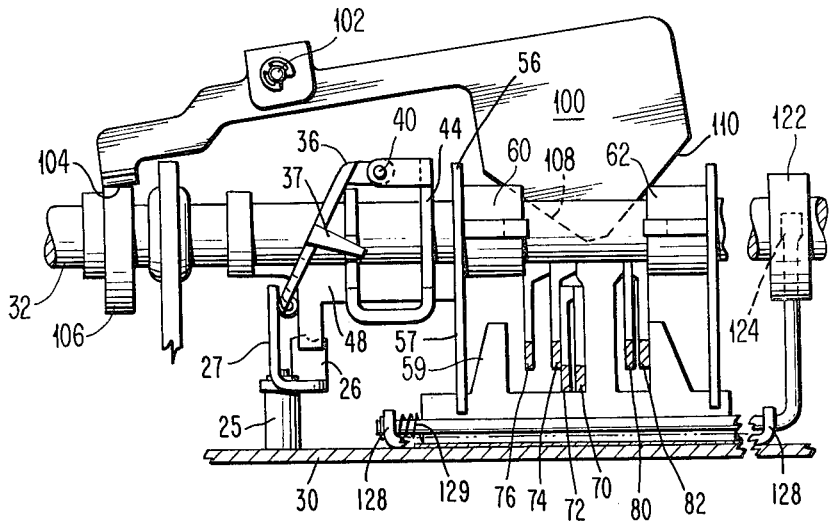
FIG. 6 is a view similar to FIG. 3 depicted half way through a machine cycle.

FIG. 6 shows the selection system of FIG. 3 as it would appear halfway through the operational cycle, with interposers 70,72 pulled, representing three units of rotation. The restore member 100 is shown withdrawn. As can be seen, cam member 36 has been displaced by an amount corresponding to three rotate units due to the withdrawal of interposers 70, 72.

The movement of the keyboard links has been directly translated into a related displacement of a blocking or slide means which, in turn, defines the cam rise amplitude for a particular cycle. The cam rise is then through conventional cam follower linkage transferred and translated into the rotation of the typehead the desired amount to present selected character at the print point, through the utilization of both rotation control and a tilting control.

While the invention has been particularly shown and described with reference to (a) preferred embodiment(s) thereof, it will be understood by those skilled in the art that the foregoing and other changes in form and details may be made therein without departing from the spirit and scope of the invention.

What is claimed is:

1. A cam controlled selection apparatus, for a single element typewriter, for controlling at least one of two degrees of movement required for selecting a character on a single typing element, comprising:

a rotatable shaft, a cam means mounted for rotating with said shaft and having a camming surface thereon;

cam follower means abutting said camming surface;

means for altering the angle of inclination of said camming surface upon axial displacement of said cam means;

means for selectively controlling the axial displacement of said cam means, thereby controlling the cam rise of said cam means; and linkage means interposed between said cam follower means and said typing element for transmitting movement of said cam follower means to said typing element.

2. The apparatus of claim 1 further comprising a coding means and said means for selectively controlling is responsive to said coding means.

3. The apparatus of claim 1, wherein said cam means is further mounted for pivotal movement with respect to and about an axis in a plane prependicular to the axis of said shaft.

4. The apparatus of claim 1, wherein said means for selectively controlling controls the displacement of said cam means to one of a plurality of discrete predefined positions.

5. The apparatus of claim 1, wherein said means for selectively controlling the axial displacement of said cam means further comprises a plurality of interposers, each of said interposers being individually retractable from a first position to a second position and compressable into engagement with other of said interposers remaining in said first position to block axial displacement of said cam means.

6. A typewriter selection mechanism for selecting the rotate and tilt movement of a single element typewriter having a single print element comprising:

displacement coding means, keyboard control means for selectively operating said displacement coding means, stop means engaging said displacement coding means, slider means displaceable to engage said stop means;

a powered shaft rotatable with said slider means and connected to a slider support means carried on said shaft;

said slider support means having pivotally mounted thereon a camming member encompassing said shaft and displaceable from a plane perpendicular to said shaft, said displacement from the perpendicular controlled by said displacement coding means, a follower means engageable with said camming member for detecting variations from the perpendicular to said shaft of said camming member, link means associated with said follower means for transmitting movement of said follower means, rotational means for rotating said single print element in response to said transmitted movement from said follower means to said rotational means through said link means.

7. A typewriter selection system for control of a single print element typewriter and having operator initiated functions, comprising a cyclically rotatable shaft, means defining a cam surface mounted and supported on said shaft for rotation therewith, said means defining a cam surface moveable with respect to said shaft to vary the rise of said cam surface with respect to a plane perpendicular to the axis of said shaft.

8. The typewriter of claim 7 further comprising a coding means, said coding means selectively controlling the amount of rise of said means defining a cam surface.

9. The typewriter of claim 7 wherein said means defining a cam surface is mounted for pivotal movement with respect to and about an axis in a plane perpendicular to said axis of said shaft.

10. The typewriter of claim 7 further comprising selective control means engageable with said means defining a cam surface to control the variance of said rise of said cam surface.

11. The typewriter of claim 10 further comprising a plurality of interposers, each of said interposers being individually retractable from a first position to a second position and compressable into engagement with other of said interposers remaining in said first position to block axial displacement of said means defining a cam surface.

12. A typewriter selection system for control of a single print element typewriter and having operator initiated functions, comprising a cyclically rotatable shaft, means defining a cam surface mounted and supported on said shaft for rotation therewith, said means defining a cam surface moveable with respect to said shaft to vary the rise of said cam surface with respect to a plane perpendicular to the axis of said shaft, means for selectably limiting the movement of said means defining said cam surface;

means for selectably controlling said means for limiting in response to operator initiated functions;

and follower means engaging said cam surface to derive selected and controlled displacement therefrom during cyclical rotation of said shaft.

13. A rotary-to-linear motion conversion device comprising a rotatable shaft and cam means mounted for rotation with the shaft and having an annular camming surface thereon encircling the shaft and engaged by a cam follower, said cam means further mounted for angular movement with respect to the axis of said shaft, the angle of inclination of the camming surface to the axis of rotation of the shaft being variable, control means for establishing the extent of said inclination being limited by selective control of axial displacement of said cam means.

14. A device according to claim 13, in which said camming surface is pivotally mounted about an axis in a plane perpendicular to the shaft axis.

15. A device according to claim 13, in which said camming surface has a mounting for angular movement comprising a pivot axis and said pivot axis is spaced from the shaft axis to one side of the shaft, and the camming surface engages a slider on the other side of said shaft, said slider being mounted for rotation with said shaft and for sliding displacement parallel with said shaft axis.

16. A device according to claim 15, in which displacement of the slider is limited by a selectively variable position stop means.

17. A device according to claim 16, in which the stop means includes a fixed stop and at least one stop member selectively interposable between the fixed stop and the slider.

18. A device according to claim 17, in which the stop means includes a plurality of selectively interposable stop members.

19. A device according to claim 18, in which the stop members are of incremental widths.

20. A typewriter character selection mechanism including two devices according to claim 19.

21. A single element typewriter comprising a single print element and including a character selection mechanism according to claim 20, in which the cam followers are connected to control rotation and tilt of said single print element, respectively.

22. A device of claim 13 further comprising restore means engageable with said cam means for returning said camming surface to a position of maximum inclination with respect to the axis of rotation of said shaft.

* * * * *